United States Patent [19]

Koslo

[11] 4,085,996

[45] Apr. 25, 1978

[54] CUBICAL THREE-CONDUCTOR ELECTRICAL TAP

[75] Inventor: Robert C. Koslo, Mentor, Ohio

[73] Assignee: International Telephone and Telegraph Corporation, New York, N.Y.

[21] Appl. No.: 782,414

[22] Filed: Mar. 29, 1977

[51] Int. Cl.[2] ..... H01R 13/50; H01R 25/02

[52] U.S. Cl. ..... 339/159 C

[58] Field of Search ..... 339/154 R, 154 A, 155 R, 339/156 R, 157 R, 157 C, 158, 159 R, 159 C, 163, 164 R, 164 M, 166 R

[56] References Cited

U.S. PATENT DOCUMENTS

| | | | |
|---|---|---|---|
| 2,226,433 | 12/1940 | Herman | 339/166 R |
| 2,267,816 | 12/1941 | Chirelstein | 339/159 C |
| 2,371,494 | 3/1945 | Benander | 339/157 C |
| 3,034,084 | 5/1962 | Schmier | 339/159 C |
| 3,156,515 | 11/1964 | More | 339/159 C |

*Primary Examiner*—Neil Abrams

*Attorney, Agent, or Firm*—James B. Raden; William J. Michals

[57] ABSTRACT

A cube tap adapter for converting a single three-conductor electrical service outlet into three service outlets. The adapter comprises a generally cubical, one-piece molded housing of insulating material. A first set of three parallel cavities or through bores is provided in the housing which extends from one surface to an opposite surface thereof. A second set of three through bores is provided in the housing, transverse to the first set, and which extends from a third surface, transverse to the first surface, and to an opposite surface of the housing. A first pair of line conductor blades are respectively received in a corresponding pair of the through bores of the first set. A second pair of conductor blades are similarly received in a pair of the through bores of the second set and are respectively connected to the first pair of blades in snap-in lock engagement therewith. First and second generally tubular ground conductor terminals are respectively received in the remaining through bores of the housing and engage one another by means of snap-in fasteners. The end portion of one of the ground conductor terminals extends away from the housing as does the end portions of the associated adjacent pair of conductor blades.

1 Claim, 13 Drawing Figures

CUBICAL THREE-CONDUCTOR ELECTRICAL TAP

BACKGROUND OF THE INVENTION

This invention relates to electrical connectors and, more particularly, to an adapter for converting a single electrical service outlet into three service outlets including ground pin receiving female contacts.

Three-way adapters for converting a single two-wire electrical service outlet into three two-wire outlets are known and have been widely used in the art. These adapters typically comprise a plastic or elastomeric housing, having at least six surfaces thereof, from which a pair of male conductor blades extend and having three pairs of female blade contacts disposed on selected surfaces of the housing. This technique has also been extended to extension cords wherein the cord is terminated in a head or housing providing two or more two-wire female plugs.

These prior art devices suffer with the disadvantages that they do not accommodate three-wire or line plugs with a third electrode or ground pin. Moreover, these prior art devices do not provide for proper alignment of the separate circuit polarities. That is, in conventional electrical wiring systems, one of the two distribution wires is permanently grounded whereas the other lead is always at the operating potential or "hot". This convention has been adopted for many reasons including safety of the operator and consumer. In the prior adapter art, provisions have not been made for maintaining this desired polarity. Further, it has become common practice to defeat three-wire plug systems by inserting the three-wire plug into these prior art adapters in such a manner that the ground pin extends over or past the terminating margin of the adapter housing. This procedure not only defeats the external grounding provision of the ground pin, but also often results in transposition of the intended circuit polarities. This is a problem.

These and other disadvantages are overcome by the present invention wherein there is provided an adapter to convert single service outlets into three-service outlets. Polarity is retained within each circuit as no cross over occurs within the adapter with respect to ground. Further, the adapter, in accordance with the present invention, will only accept a male line plug, with its associated ground pin, in a manner wherein the proper circuit polarities are maintained.

SUMMARY OF THE INVENTION

Briefly, an adapter device for converting a single three-conductor grounded electrical service outlet into three service outlets is provided. The device includes a housing of insulating material having at least six sides thereof. First and second line conductor terminals are mounted within the housing and respectively extend parallel to one another and from a pair of spaced-apart openings on one surface of the housing, through the housing and project externally of the housing away from a second surface which is opposite to the first surface. A first ground conductor terminal is mounted within the housing and extends from a third opening on the first surface through the housing, parallel to the first and second terminals, and away from the housing and on one side of the plane formed by the first and second terminals and in spaced-apart relationship therewith. Third and fourth line conductor terminals are mounted within the housing and respectively extend from a pair of spaced-apart openings on a third surface of the housing. The third and fourth line conductors extend to a pair of openings on a fourth surface of the housing which is opposite to the third surface. The third and fourth line conductor terminals are parallel to one another and transverse to the first and second conductor terminals. A second ground conductor is mounted within the housing and extends transversely of the first ground conductor. The second ground conductor extends between the third surface and a third opening on the fourth surface. The second ground conductor is spaced-apart from the plane formed by the third and fourth conductor terminals. Means are provided for connecting the first and second ground connectors within the housing; and means are further provided for connecting the first and second line conductor terminals respectively with the third and fourth line conductor terminals. The third surface includes a third opening therein which is spaced-apart from the plane formed by the third and fourth line conductors and which overlies an intermediate portion of the first ground conductor.

BRIEF DESCRIPTION OF THE DRAWING

The advantages of this invention will become more readily appreciated as the thing becomes better understood by reference to the following detailed desctiption when taken in conjunction with the accompanying drawing wherein.

DETAILED DESCRIPTION

Figure 1:
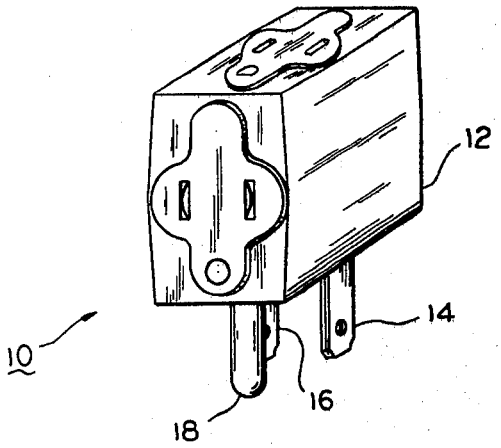
FIG. 1 is a prospective view of the cubical three-conductor electrical tap in accordance with the principles of the present invention.

Referring now to FIG. 1 there is shown generally at 10 an adapter device for converting a single three-conductor grounded electrical service outlet into three service outlets, in accordance with the principles of the present invention. Device 10 includes a housing 12 of insulating material such as plastic, rubber or any other suitable material. A pair of line conductor terminals 14 and 16 extend from housing 12 for electrical and mechanical engagement with the corresponding sockets or female terminals of the single service outlet. A ground pin 18 similarly extends from housing 12 and engages a corresponding female contact of the single electrical service outlet. As is well known in the art, ground pin 18 extends from housing 12 to a greater extent than line conductor terminals 14 and 16. As will be explained more fully hereinafter, this differential dimension is advantageously utilized in the present invention.

Figure 2C:
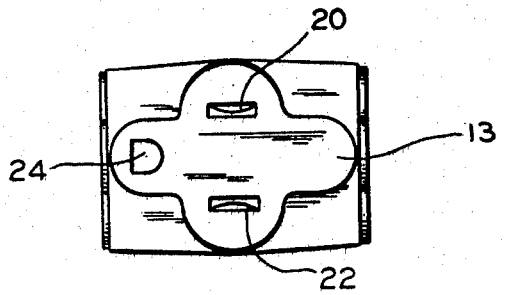
FIGS. 2*a–d* provide plan, end and top views of the adapter device illustrated in FIG. 1.
Figure 2B:
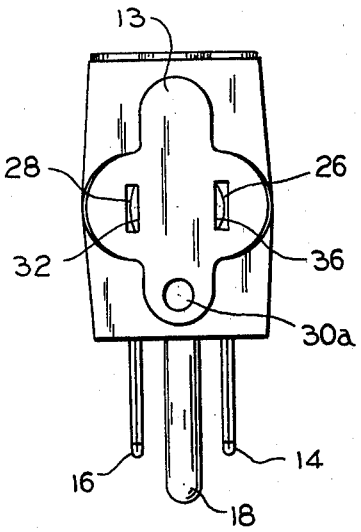
Figure 2A:
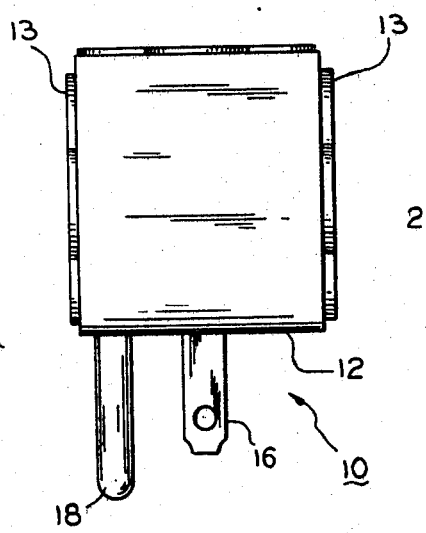
Figure 2D:
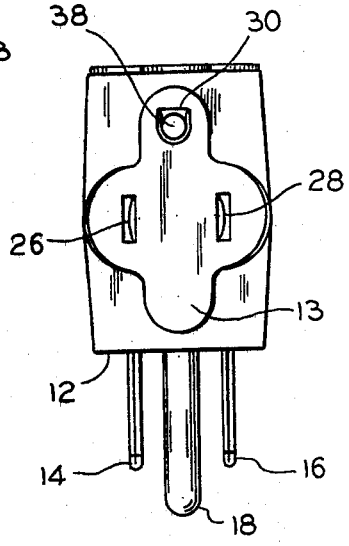
Figure 3B:
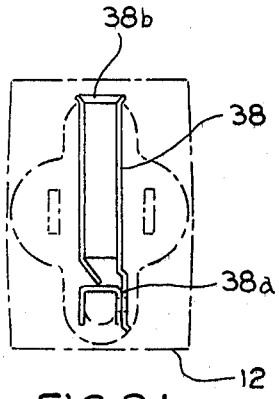
FIGS. 3*a–b* provide internal views of the housing of the adapter device in accordance with the present invention, illustrating the structure, position and function of the ground conductor terminals therein.
Figure 3A:
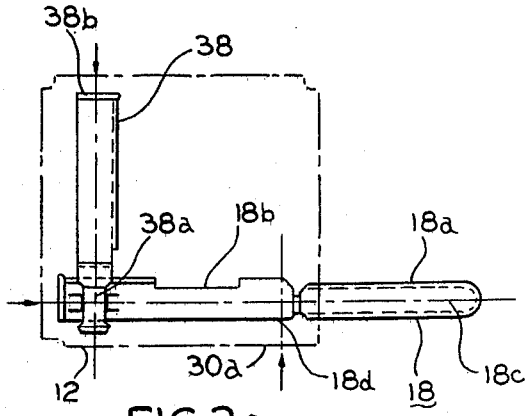
Figure 4B:
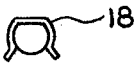
FIGS. 4*a–c* are detailed views of one of the ground conductor terminals of the previous figures; and, FIGS. 5*a–c* are internal views of the adapter device illustrating somewhat more clearly the structure, positions and function of the conductor blade terminals therein.
Figure 4A:
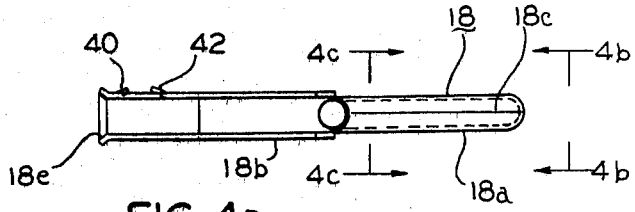
Figure 5B:
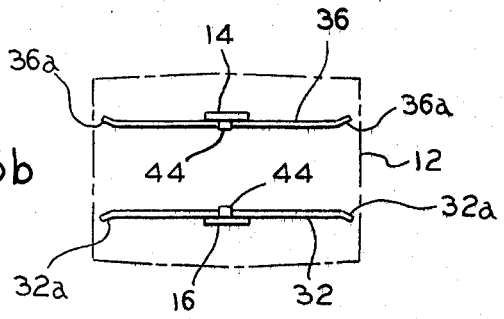
Figure 4C:
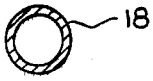
Figure 5A:
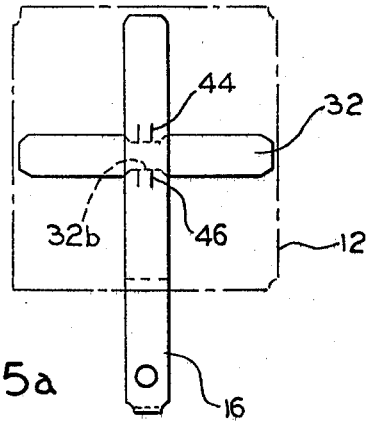
Figure 5C:
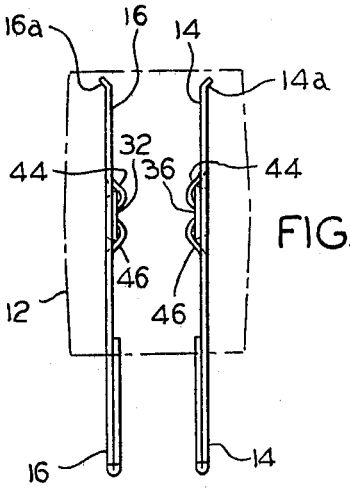

Referring now to FIGS. 2*a–d*, it can be seen that housing 12 includes a first set of cavities or throughbores 20, 22 and 24, as best illustrated in FIG. 2*c*. A second set of cavities 26, 28 and 30 are similarly provided along the direction which is transverse to the direction of the first set of cavities. Through hole or cavity 30 extends through housing 12 but terminates just short of the surface which is opposite to the surface illustrated in FIG. *2d*. However, an aperture or counter sunk hole 30*a* is provided along a lower portion of housing 12 as illustrated in FIG. *2b*. Aperture 30*a* can be considered as essentially a continuation of through hole 30 except that its physical location is translated to a lower portion of housing 12 as best seen with reference to FIG. *3a*. Still referring to FIGS. *2a–d*, it can be seen that device 10 further includes a second pair of line conductor terminals 32 and 36 which extend from substantially end to end of cavities 28 and 26, respectively. A second ground conductor terminal 38 is provided in cavity 30 and extends substantially to the remote end of cavity 30 which is adjacent the opposite side of housing 12 with respect to FIG. *2d*.

FIGS. *2a–d* further illustrate a plurality of bosses 13 which are provided on the side of each plug receiving surface which is opposite to the ground pin receiving apertures. The bosses extend away from the respective line conductor terminals a distance sufficient to prevent insertion of the external line plugs in the reverse, or improper polarity, orientation. Thus, unlike the prior art two-wire adapters, it is not possible to insert an external plug into device 10 of the present invention, unless the ground pin is properly oriented. Further, the extended dimension of the ground pin of the external plug, essentially precludes contact between its male line conductor terminals and the line conductor terminal blades within the housing 12.

Referring now to FIGS. *3a* and *3b*, there is shown an internal view of housing 12 illustrating the arrangement, function and interlocking relationship of ground conductor terminals 18 and 38. It can be seen that terminal 18 includes a generally cylindrical male electrode portion 18*a* and a generally U-shaped body portion 18*b* which is received within housing 12. As can be seen by reference to FIGS. *4a–c*, body portion 18*b* includes struck-out tabs 40 and 42 which are adapted to retainingly engage associated ground terminal 38 in push-in, snap-in relationship therewith. Terminals 18 and 38 are preferrably formed by stamping or shaping a sheet metal blank or strip of suitable conductive material such as brass, bronze or any other suitable metal of sufficient hardness and resiliency to provide the desired spring qualities to meet a given application. In this regard, male portion 18*a* of terminal 18 comprises a substantially tubular body having a longitudinal slot 18*c* extending from end to end thereof. The portion of terminal 18 adjacent to male portion 18*a* is provided with an aperture in the base of the generally U-shaped section to receive an external male grounding pin of an associated three-wire plug through aperture 30*a*.

Referring again to FIGS. *3a* and *3b*, it can be seen that ground conductor terminal 38 includes a reduced or necked-down portion 38*a* which is retainingly received between projecting tabs 40 and 42 of ground conductor terminal 18. The end portion of terminal 38 includes flared edges 38*b* for accommodating the insertion of an external ground pin of an associated plug. In actual practice, during the assembly of the adapter device 10, in accordance with the principles of the present invention, ground conductor 38 is first inserted into its cavity of the housing 12. Thereafter, ground conductor terminal 18 is inserted into its corresponding cavity until struck-out portion 40 engages the reduced portion 38*a* of the previously inserted ground terminal 38. Thereafter, continued insertion or movement of terminal 18 causes reduced portion 38*a* to slide over the ramp provided by struck-out portion 40 until reduced portion 38*a* is engaged or captured between struck-out portions 40 and 42 in snap-in engagement therewith.

Referring now to FIGS. *5a–5c*, there are provided internal views of adapter 10, in accordance with the present invention, illustrating the structure, arrangement and function of line conductor terminals 14 and 16, and 32 and 36. It can be seen that the end portions of blade terminals 32 and 36 are respectively provided with deflected or flared portions 32*a* and 36*a*. These deflected portions are provided to facilitate the insertion of the male line terminals of an associated three-wire plug. Similarly, blade terminals 14 and 16 are provided with deflected or flared end portions 14*a* and 16*a*, respectively. Further, blade terminals 14 and 16 are provided with struck-out portions 44 and 46; and, blade terminals 32 and 36 are provided with reduced or necked-down portions as at 32*b* in FIG. *5a*. This structure functions in a manner essentially identical to the snap-in retaining engagement structure 40, 42 and 38*a* of ground terminals 18 and 38. In actual practice, blade terminals 32 and 36 are first inserted into their respective through bores or cavities; and, thereafter, blade terminals 14 and 16 are inserted into their respective cavities until necked-down portions 32*b* are captured between struck-out portions or ramps 44 and 46 of the respectively connected blade terminals 32 and 36.

What has been taught, then, is an adapter for converting a single service outlet into a three-service outlet and facilitating, notably, a one-piece molded housing with through bores or cavities that locate and pilot the blades and conductors into snap-in retaining engagement during the assembly process. The form of the invention illustrated and described herein is but a preferred embodiment of these teachings, in the form currently preferred for manufacture. It is shown as an illustration of the inventive concepts, however, rather than by way of limitation, and it is pointed out that various modifications and alterations may be indulged in within the scope of the appended claims.

Having thus described my invention, what I claim as new and desire to protect by United States Letters Patent is:

1. An adapter device for converting a single three-conductor grounded electrical service outlet into three service outlets, said device comprising, in combination:

an intégral one-piece housing of insulating material and having at least six sides thereof;

first and second line conductor terminals slidably inserted and mounted within said housing and respectively extending parallel to one another and from a pair of spaced-apart openings on one surface of said housing, through said housing and projecting externally of said housing and away from a second surface which is opposite said one surface;

a first ground conductor terminal slidably inserted and mounted within said housing and extending from a third opening on said one surface through said housing, parallel to said first and second terminals, away from said housing and on one side of the plane formed by said first and second terminals in spaced-apart relationship therewith;

third and fourth line conductor terminals slidably inserted and mounted within said housing and respectively extending from a pair of spaced-apart openings on a third surface of said housing to a pair of openings on a fourth surface of said housing which is opposite to said third surface, said third and fourth line conductor terminals being parallel to one another and transverse to said first and second conductor terminals;

a second ground conductor slidably inserted and mounted within said housing and extending transversely of said first ground conductor and between said third surface and a third opening on said fourth surface, said second ground conductor being spaced-apart from the plane formed by said third and fourth conductor terminals;

means for connecting said first and second ground connectors within said housing and for connecting said first and second line conductor terminals respectively with said third and fourth line conductor terminals, said means including an integral snap-in fastener on each of said conductors for retainingly engaging a mating fastener on the corresponding conductor to which each conductor is respectively connected, wherein the respective connected conductors are fixedly mounted within said housing by sliding one of said connected connectors into snap-in retaining engagement with the other of said connected conductors; and, said third surface having a third opening therein which is spaced-apart from the plane formed by said third and fourth line conductors and which overlies an intermediate portion of said first ground conductor.

* * * * *